United States Patent [19]

Ivanko

[11] 4,207,029

[45] Jun. 10, 1980

[54] TURBINE ROTOR ASSEMBLY OF CERAMIC BLADES TO METALLIC DISC

[75] Inventor: Theodore Ivanko, Fairfield, Conn.

[73] Assignee: Avco Corporation, Stratford, Conn.

[21] Appl. No.: 914,785

[22] Filed: Jun. 12, 1978

[51] Int. Cl.[2] ..... F01D 5/28; F01D 5/30

[52] U.S. Cl. ..... 416/241 B; 416/220 R

[58] Field of Search ..... 416/219, 220, 221, 241 B

[56] References Cited

U.S. PATENT DOCUMENTS

| | | | |
|---|---|---|---|
| 3,216,699 | 11/1965 | Schoenborn | 416/220 |
| 3,317,988 | 5/1967 | Endres | 416/219 R |
| 3,784,320 | 1/1974 | Rossmann et al. | 416/241 B |
| 3,814,539 | 5/1974 | Klompas | 416/220 |
| 3,910,719 | 10/1975 | Hessler et al. | 416/219 R |
| 4,051,585 | 10/1977 | Walker et al. | 416/241 B |

FOREIGN PATENT DOCUMENTS

| | | | |
|---|---|---|---|
| 2250563 | 5/1973 | Fed. Rep. of Germany | 416/241 B |
| 836030 | 6/1960 | United Kingdom | 416/241 B |

*Primary Examiner*—Everette A. Powell, Jr.
*Assistant Examiner*—A. N. Trausch, III
*Attorney, Agent, or Firm*—Ralph D. Gelling

[57] ABSTRACT

In a turbine rotor assembly wherein ceramic blades are secured to slots provided in the periphery of a metallic rotor disc, a metallic jacket is interposed between each blade root and disc slot, and ceramic potting material is, in turn, interposed between the metallic jacket and the ceramic blade root. The metallic jacket also includes locking means to prevent upstream or downstream axial movement of the blade in the disc slot, with the resulting assembly effectively isolating the ceramic root from high localized loads and permitting a more uniform stress distribution on the critical root load bearing surfaces.

1 Claim, 2 Drawing Figures

TURBINE ROTOR ASSEMBLY OF CERAMIC BLADES TO METALLIC DISC

BACKGROUND OF THE INVENTION

1. Field of the Invention

The subject invention generally relates to turbomachines, and more particularly to an arrangement for providing an assembly for the mechanical attachment of a ceramic turbine blade to a metallic rotor disc.

2. Description of the Prior Art

The high pressure turbine of the subject invention is intended for use in gas turbine engines, and heretofore, turbines were manufactured with a high degree of precision and accuracy in order to achieve optimum performance and life. To that end, it was required to utilize precision machinery to achieve precision machining of the various parts of the turbine, such that the resulting assembly was characterized by close fitting tolerances. As is readily apparent, such manufacturing techniques are costly and time-consuming. Thus, it is desirable to obtain the manufacture of a gas turbine having wide tolerance components, yet the final assembly may be rapidly and readily assembled with fine precision and accuracy.

Another aspect of high performance turbines is to maximize the thermal efficiency and power output of the turbine. It is known that the thermal efficiency and power output of a turbine depends upon the temperature of the operating fluid. Higher thermal efficiency of a turbine is achieved when higher operating fluid temperatures are handled by the gas turbine. However, the main limiting factor in raising the temperature efficiency and power output is the physical capacity of the rotating blades. In general, turbine blades made from high-temperature resistant superalloys are capable of withstanding temperatures of approximately 1,800°-2,000° F. Advances in ceramics, such as silicon nitride ($Si_3N_4$) and silicon carbide (SiC), will allow initial turbine temperatures in the range of 2,300°-2,600° F. Ceramics, however, are not as compliant as metals. Generally, a ceramic blade root with its inherent high notch sensitivity, low ductility, and low coefficient of thermal expansion is particularly prone to failure in the environment of a gas turbine. Generally, any introduction of tensile stresses in critical areas may propagate cracks in the ceramics, and the blade will fail. In other words, high point-loading and resulting stress concentration are of primary concern in a ceramic blade root attachment. Localized high load areas are due, in part, to uncontrollable variations in coefficients of friction, alignment, manufacturing tolerances, and tangential load. Therefore, in the design of the ceramic blade and rotor disc attachment, it is of primary importance to minimize tensile stresses when adapting the ceramic blades to the metallic rotor.

Heretofore, it has been known to cushion the area of contact between the ceramic blade root and the slot in the rotor by the use of an intermediate layer of woven or felted metal, by ceramic fiber, or asbestos cloth. Generally, this type of sandwich wadding is undesirable because it does not provide uniform support to the blade root, and possibly gives rise to slippage loss of material, stress overloading, matting, and pulverization of the intermediate materials. In addition, such slippage could result in upstream or downstream movement of the ceramic blade relative to the rotor disc.

SUMMARY OF THE INVENTION

The present invention provides a simple, economical, effective, easily manufacturable arrangement for mounting ceramic turbine blades on a rotor. The assembly of the present invention effectively isolates the ceramic root of the ceramic blade from high localized loads and permits a more uniform stress distribution on the critical root load bearing surfaces. This is achieved by using a conforming metal jacket and ceramic potting compound between the ceramic blade root and the metal disc slot. More particularly, the ceramic blade root is centrally positioned in an oversized metal jacket, after which an intermediate layer of ceramic potting material is injected between the ceramic blade root and the metal jacket. The intermediate potting material separates the ceramic blade root from the metallic surfaces while, at the same time, allowing relatively loose manufacturing tolerances in the ceramic root thereby avoiding costly machining of the ceramic blade. The metallic jacket is finished ground using conventional machining techniques.

The assembly of the subject invention also includes a blade root locking device to prevent axial movement of the ceramic blade, both upstream and downstream, in the disc slot due to gas load or centrifugal load components which do not preload the ceramic. More particularly, the blade root locking device of the subject invention includes a mounting plate which is bolted to the rotor disc and which cooperates with an extension of the metal jacket to provide a cooperating assembly for the reception of a retention wire. The assembly of the retention wire and the cooperating elements prevents upstream movement of the blade, while relative rearward movement of the ceramic blade to the rotor disc is prevented by a bent tab on the aft end of the oversized metal jacket.

DESCRIPTION OF PREFERRED EMBODIMENTS

Figure 1:
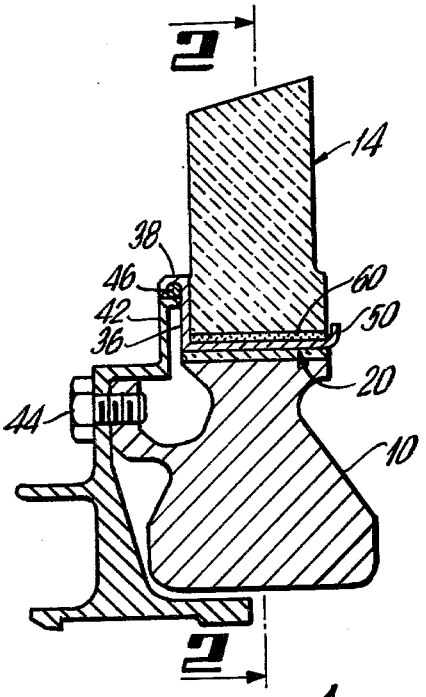
FIG. 1 is a sectional view taken through a turbine rotor incorporating the subject invention.

The illustrated embodiment of this invention is a rotary axial turbine wheel of a gas turbine engine. The turbine includes a metallic rotor disc 10 having a central aperture through which the gas turbine shaft (not shown) extends and to which the disc is affixed. The disc 10 is manufactured with slots 12 in its periphery which are generally oriented in an axial direction. Ceramic turbine blades 14, each having a root 16 and an airfoil section 18, are peripherally mounted on the disc 10. The slots 12 are configured to loosely contain the roots 16. It is noted that the subject invention, the slots 12 and the roots 16 are cast or machined without close tolerances so that there is a loose fit between the blade roots and the walls of the slots, such that a gap exists between the roots and the walls of the slots, which gap is filled with the mounting assembly of the subject invention.

Figure 2:
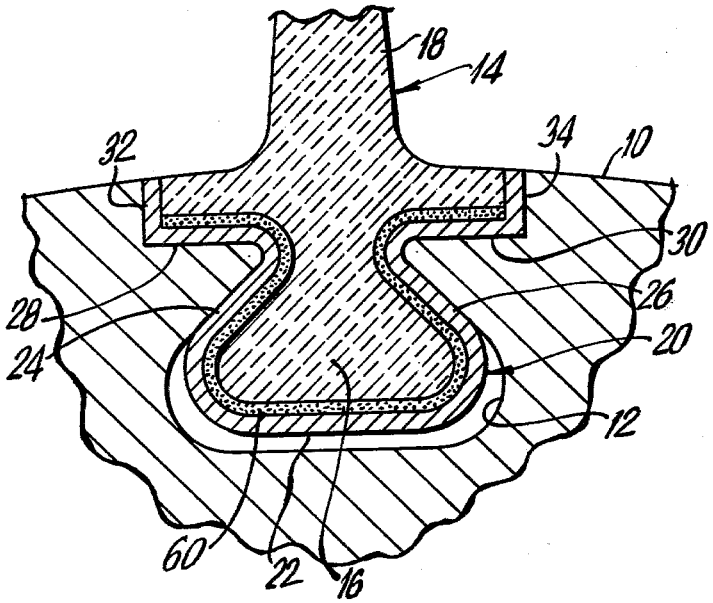
FIG. 2 is a sectional view taken along line 2—2 in FIG. 1.

Turning to FIG. 2, disposed in the gap between the blade root 16 and the slot 12 is an elongated, generally U-shaped metallic jacket 20 which generally conforms to the configuration of the root 16 of the ceramic blade. More particularly, metallic jacket 20 includes a base 22 from which extend two inwardly and upwardly inclined arms 24, 26 corresponding in configuration to the dovetail slot 12. Extending respectively from arms 24 and 26 are outwardly directed flanges 28 and 30. In turn, extending from the free ends of the flanges 28 and 30 are radial projections 32 and 34. It is noted that the radial projections 32 and 34 are disposed generally perpendicular to the flanges 28 and 30, and also generally perpendicular to the base 22 of the metallic jacket 20. The ceramic blade root 16 is centrally positioned in the oversized metallic jacket 20, and an intermediate layer of ceramic potting material 60 is injected between the jacket 20 and the blade root 16 so as to separate and effectively isolate the ceramic root 16 from the metallic surfaces of the jacket 20 and the rotor disc 10. Thus, the intermediate ceramic potting material 60 allows relatively loose manufacturing tolerances in the manufacture of the ceramic root 16 thereby avoiding costly machining of the ceramic blade 14. The metallic jacket 20 is preferably finished ground, using conventional machining techniques, so as to generally conform to the configuration of the dovetail slot 12.

As illustrated in FIG. 1, the subject blade mounting assembly includes blade root locking means to prevent upstream or downstream axial movement of the blade relative to the slot 12 in response to gas loading or centrifugal load components which do not preload the ceramic blade 14. More particularly, disposed adjacent the leading edge of the ceramic blade, and unitary with the metallic jacket 20, is an extension 36 having a flange 38 provided with a groove. A mounting plate 42 is bolted as at 44 to the disc 10, and includes a flange directed toward the flange 38 of extension 36.

In the assembly of the turbine rotor assembly of the subject invention, after the ceramic blade 14 and the metallic jacket 20 are fixed in place, a retention wire 46 is inserted into the groove in flange 38, and mounting plate 42 is bolted as at 44 to the rotor disc 10 in such manner as to trap the retention wire 46. This arrangement prevents upstream movement or slippage of the ceramic blade relative to the jacket 20 and the disc 10.

The downstream end of the metallic jacket 20 includes a bent tab 50 which prevents relative rearward movement of the ceramic blade to the disc 10. Accordingly, any gas loading on the blade or centrifugal load components on the blade tending to move it upstream or downstream will be resisted by the blade root locking means formed as an integral part of the metallic jacket 20.

Accordingly, there is provided a new and improved assembly of a ceramic blade to a metallic rotor disc wherein metallic jacket means and yieldable support means in the form of ceramic potting material effectively isolate the ceramic blade root from the high localized loads developed within the disc member during operation of the rotor. Furthermore, the assembly permits a more uniform stress distribution on the critical root load bearing surfaces of the ceramic blade. In addition, locking means are provided in the assembly to maintain the ceramic blade within the disc, slot in the presence of axial loads tending to shift the blade upstream or downstream relative to the rotor disc. The resulting assembly provides a simple, economical and easily manufactured arrangement for mounting the ceramic turbine blades on the rotor and avoids costly machining techniques, as heretofore required for mounting ceramic blades on a metallic rotor disc.

While the invention has been described in detail with respect to a single embodiment of the invention, it will be understood by those skilled in the art that various changes and modifications may be made without departing from the spirit and scope of the invention, and it is intended, therefore, to cover all such changes and modifications in the appended claims.

What is claimed is:

1. In a turbine rotor for use in a gas turbine engine, the combination comprising:

a metallic rotor disc having a plurality of slots constructed in the outer periphery thereof;

a plurality of ceramic turbine blades, each being formed with an airfoil section and a blade root, said root being loosely positioned within a disc slot;

a metallic jacket interposed between each of the blade roots and the slots;

a mounting plate secured to the rotor disc and disposed adjacent one edge of the blade;

an extension provided on said metallic jacket for cooperation with said mounting plate to form a closed slot in which a retaining wire is inserted to prevent axial movement of the blade;

a bent tab portion provided on said metallic jacket adjacent the other edge of the ceramic blade to engage the rotor and prevent axial movement of the blade; and ceramic potting material interposed between each of the blade roots and its corresponding metallic jacket to support said elements in spaced relation.

* * * * *